US009480377B2

(12) United States Patent
Kim

(10) Patent No.: US 9,480,377 B2
(45) Date of Patent: Nov. 1, 2016

(54) EXTENSION TUBE OF VACUUM CLEANER

(71) Applicant: JIANGSU GUOXIN METAL PRODUCTS CO., LTD., Zhangjiagang (CN)

(72) Inventor: Yoonki Kim, Zhangjiagang (CN)

(73) Assignee: JIANGSU GUOXIN METAL PRODUCTS CO., LTD, Tangqiao Town Zhangjiangang, Jiangsu (CN)

( * ) Notice: Subject to any disclaimer, the term of this patent is extended or adjusted under 35 U.S.C. 154(b) by 101 days.

(21) Appl. No.: 14/113,566

(22) PCT Filed: Oct. 29, 2012

(86) PCT No.: PCT/CN2012/083702

§ 371 (c)(1),
(2) Date: Oct. 24, 2013

(87) PCT Pub. No.: WO2013/064050

PCT Pub. Date: May 10, 2013

(65) Prior Publication Data

US 2014/0283333 A1 Sep. 25, 2014

(30) Foreign Application Priority Data

Nov. 2, 2011 (KR) ..... 10-2011-0113452
May 9, 2012 (CN) ..... 2012 1 0140074

(51) Int. Cl.
*A47L 9/24* (2006.01)

(52) U.S. Cl.
CPC ..... *A47L 9/244* (2013.01)

(58) Field of Classification Search
CPC ..... A47L 9/244; A47L 9/02; A47L 9/242
See application file for complete search history.

(56) References Cited

U.S. PATENT DOCUMENTS

| | | | | |
|---|---|---|---|---|
| 5,332,266 | A * | 7/1994 | Canale | A47L 9/244 285/24 |
| 6,237,962 | B1 * | 5/2001 | Lim | A47L 9/244 285/303 |
| 6,474,696 | B1 * | 11/2002 | Canale | A47L 9/244 285/316 |
| 7,516,988 | B2 * | 4/2009 | Lin | A47L 9/244 15/414 |
| 2002/0047264 | A1 * | 4/2002 | Kim | A47L 9/244 285/7 |
| 2007/0180651 | A1 * | 8/2007 | Muhlenkamp | A47L 9/244 15/410 |
| 2010/0123305 | A1 * | 5/2010 | Shih | A47L 9/244 285/7 |
| 2013/0175767 | A1 * | 7/2013 | Cordes | F16J 15/02 277/602 |
| 2014/0042739 | A1 * | 2/2014 | Zeng | A47L 9/244 285/145.1 |

* cited by examiner

*Primary Examiner* — Dung Van Nguyen
(74) *Attorney, Agent, or Firm* — Flener IP Law, LLC; Zareefa B. Flener

(57) ABSTRACT

An extension tube for a vacuum cleaner comprises an outer tube, an inner tube slidingly sheathed in the outer tube, wherein the front end of the inner tube being embedded with a sealing component with an end extending out from the inner tube, the inner tube being provided with several rows of clamping grooves, and each row of clamping grooves being provided with a plurality of clamping grooves at intervals in the length direction, and a length adjustment component mounted on the rear end of the outer tube and used for selectively fixing the inner tube to adjust the length of the extension tube.

6 Claims, 2 Drawing Sheets

EXTENSION TUBE OF VACUUM CLEANER

TECHNICAL FIELD

The invention relates to a vacuum cleaner, in particular to an extension tube for a vacuum cleaner.

BACKGROUND OF THE INVENTION

A vacuum cleaner generally comprises a cleaner main body capable of generating a suction force and collecting wastes via the sucked air; a brush assembly used while the outer air, dust and other dirt are sucked by the suction force of the cleaner main body; and, an extension tube, a handle component, a flexional hose and other parts used while dirt and air sucked by the brush assembly are sucked to the air cleaner main body.

The original extension tube is embedded with a sealing component at the front end (an end connected with the outer tube) of the inner tube. Ends of the sealing component are extended out from the inner tube, and the diameter of the ends of the sealing component is equivalent to the inner diameter of the outer tube. After the inner tube and the outer tube have been assembled, the ends of the sealing component extended out from the inner tube seals the inner tube with the outer tube. As a space about 1 mm in diameter exists between the inner tube and the outer tube, the inner tube and the outer tube may shake while in service, and because the inner and outer tubes are long, the shaking value of a tube end may reach about 15 mm, thereby influencing the service. In addition, it is likely to make the ends of the sealing component extended out from the inner tube generate deformation, thereby worsening the sealing effect and affecting performance of the vacuum cleaner.

SUMMARY OF THE INVENTION

The technical problem to be solved by the invention is to provide an extension tube for a vacuum cleaner with slight shaking of inner and outer tubes when in service and good sealing performance.

To solve the above technical problem, the invention employs a technical solution as below. An extension tube for a vacuum cleaner is provided, comprising: an outer tube; an inner tube slidingly sheathed in the outer tube, the front end of the inner tube being embedded with a sealing component with an end extending out from the inner tube, the inner tube being provided with several rows of clamping grooves, and each row of clamping grooves being provided with a plurality of clamping grooves at intervals in the length direction; and a length adjustment component, mounted on the rear end of the outer tube and used for selectively fixing the inner tube to adjust the length of the extension tube. The front end of the inner tube is provided with a cylindrical sealing reinforcing component.

There are two rows of clamping grooves, which are separated from each other on the outer circumferential surface of the inner tube, and the sealing reinforcing component is provided with two positioning bumps fitted with the clamping grooves.

The lower part of the circumferential surface of the inner tube is provided with a rail groove for preventing rotation in the length direction, and the sealing reinforcing component is provided with a rotation-preventing protrusion fitted with the rail groove.

The sealing reinforcing component is provided with an extension groove, and the extension groove is located on perpendicular bisectors of the two positioning blocks and throughout the whole seal reinforcing component axially.

The seal reinforcing component is provided with mounting notches on two ends, respectively, to sheath the seal reinforcing component on the inner tube conveniently.

The invention has the following advantages. Because the inner tube is sleeved with a sealing reinforcing component having a supporting function for the inner and outer tubes, the relative shaking between the inner and outer tubes are reduced and the extension tube for a vacuum cleaner is used conveniently. Meanwhile, the deformation of the sealing reinforcing component is avoided in service, and the sealing reinforcing component itself has a certain sealing function, thereby greatly enhancing the overall tightness of the extension tube for a vacuum cleaner and improving the use performance of the vacuum cleaner.

Because the sealing reinforcing component is provided with two positioning bumps fitted with the clamping grooves, the sealing reinforcing component is difficult to slide after mounted on the inner tube.

Because the sealing reinforcing component is provided with a rotation preventing protrusion fitted with the rail groove, the sealing reinforcing component is easy to rotate with respect to the inner tube.

Because the sealing reinforcing component is provided with an extension groove, and the extension groove is located on perpendicular bisectors of the two positioning bumps and throughout the whole seal reinforcing component axially, the sealing reinforcing component is easier to be sheathed on the inner tube.

BRIEF DESCRIPTIONS OF THE DRAWINGS

Figure 1:
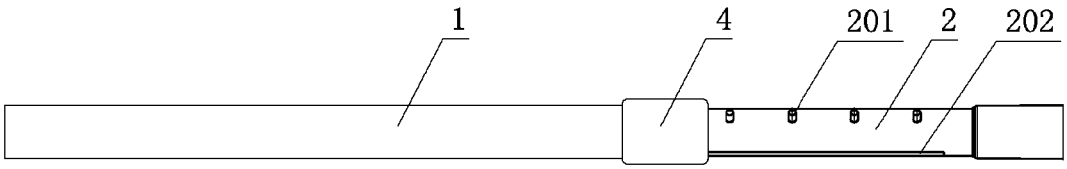
FIG. 1 is a structure view of the invention.
Figure 2:
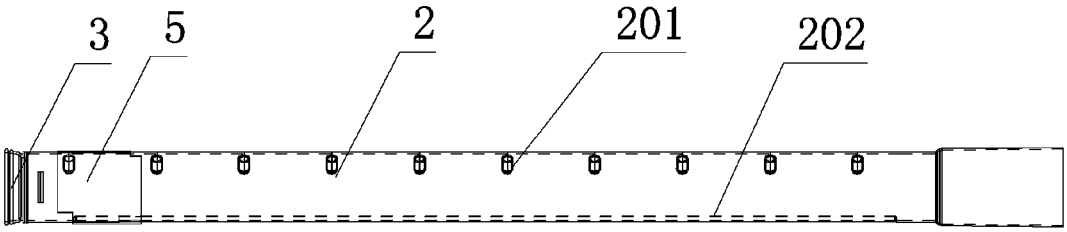
FIG. 2 is a structure view of an inner tube and parts mounted thereon in the invention.
Figure 3:
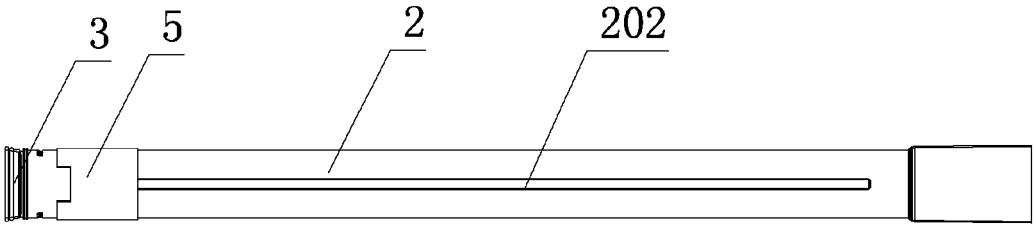
FIG. 3 is a bottom structure view of FIG. 2.
Figure 4:
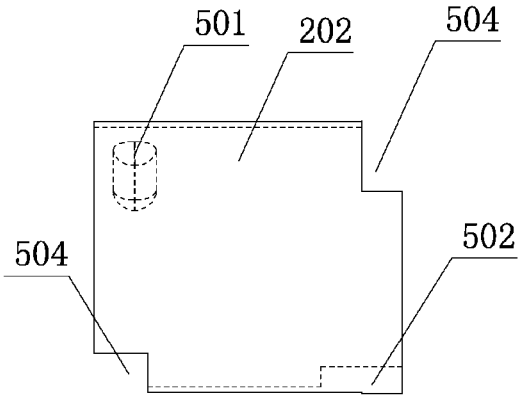
FIG. 4 is a front structure view of a sealing reinforcing in the invention.
Figure 5:
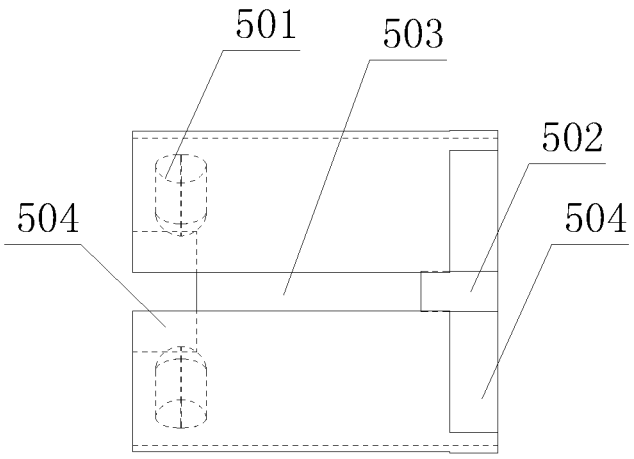
Figure 6:
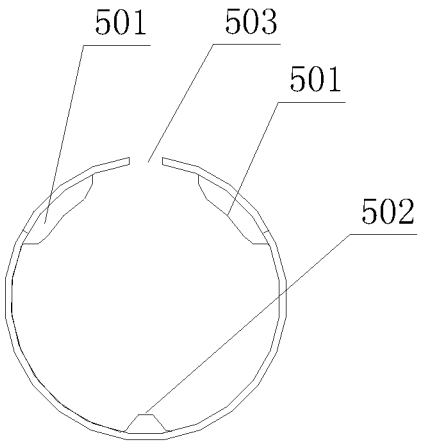

FIG. 5 is a top structure view of a sealing reinforcing in the invention; and, FIG. 6 is a right structure view of a sealing reinforcing in the invention, In FIG. 1 to FIG. 6: 1-Outer tube; 2-Inner tube; 201-Clamping grooves; 202-Rail groove; 3-Sealing component; 4-Length adjustment component; 5-Sealing reinforcing component; 501-Positioning bumps; 502-Rotation preventing protrusion; 503-Extension groove; and, 504-Mounting notches.

DETAILED DESCRIPTIONS OF THE INVENTION

Specific embodiments of the invention are described as below in details with reference to the drawings.

An embodiment of an extension tube for a vacuum cleaner is shown in FIG. 1-6, comprising an outer tube 1; an inner tube 1 slidingly sheathed in the outer tube 1, the front end of the inner tube being embedded with a sealing component 3 with an end extending out from the inner tube 2, the inner tube 2 being provided with several rows of clamping grooves that are separated from each other on the outer circumferential surface of the inner tube 2, and each row of clamping grooves being provided with a plurality of clamping grooves 201 at intervals in the length direction; and a length adjustment component 4, mounted on the rear end of the outer tube 1 and used for selectively fixing the inner tube 2 on the outer tube 1 to adjust the length of the extension tube. The front end of the inner tube 2 is provided with a cylindrical sealing reinforcing component 5, which is provided with two positioning bumps 501 fitted with the clamping grooves 201. The lower part of the circumferential surface of the inner tube 2 is provided with a rail groove 202 for preventing rotation in the length direction, and the sealing reinforcing component 5 is provided with a rotation preventing protrusion 502 fitted with the rail groove 202. The sealing reinforcing component 5 is provided with an extension groove 503, which is located on perpendicular bisectors of the two positioning bumps 501 and throughout the whole seal reinforcing component 5 axially. The seal reinforcing component 5 is provided with mounting notches 504 on two ends, respectively, to sheath the seal reinforcing component 5 on the inner tube 2 conveniently.

Because the inner tube 2 is sheathed with a sealing reinforcing component 5 having a supporting function for the inner tube 2 and the outer tube 1, the relative shaking between the inner tube 2 and the outer tube 1 are reduced so that the shaking value on the tube end may be controlled within about 1 mm and the extension tube for a vacuum cleaner is used conveniently. Meanwhile, the deformation of the sealing reinforcing component 3 is avoided in service, and the sealing reinforcing component itself has a certain sealing function, thereby greatly enhancing the overall tightness of the extension tube for a vacuum cleaner and improving the use performance of the vacuum cleaner.

Because the sealing reinforcing component 5 is provided with two positioning bumps 501 fitted with the clamping grooves 201, the sealing reinforcing component 5 is difficult to slide after mounted on the inner tube 2.

Because the sealing reinforcing component 5 is provided with a rotation preventing protrusion 502 fitted with the rail groove 202, the sealing reinforcing component 5 is easy to rotate with respect to the inner tube 2.

Because the sealing reinforcing component 5 is provided with an extension groove 503, and the extension groove 503 is located on perpendicular bisectors of the two positioning bumps 501 and throughout the whole seal reinforcing component 5 axially, the sealing reinforcing component 5 is easier to be sheathed on the inner tube 2.

The invention claimed is:

1. An extension tube for a vacuum cleaner, comprising: an outer tube; an inner tube slidingly sheathed in the outer tube, the front end of the inner tube being embedded with a sealing component with an end extending out from the inner tube, the inner tube being provided with several rows of clamping grooves, and each row of clamping grooves being provided with a plurality of clamping grooves at intervals in the length direction; and a length adjustment component, mounted on the rear end of the outer tube and used for selectively fixing the inner tube to adjust the length of the extension tube, wherein the circumferential surface of the inner tube has an upper and a lower part, wherein the lower part of the circumferential surface of the inner tube is provided with a rail grove along the length of the inner tube, wherein the front end of the inner tube is provided with a cylindrical sealing reinforcing component provided with a rotation preventing protrusion fitted with the rail groove on the lower part of the circumferential surface of the inner tube thereby preventing rotation of the sealing reinforcing component apart from the inner tube.

2. The extension tube for a vacuum cleaner according to claim 1, wherein there are two rows of clamping grooves on the upper part of the circumferential surface of the inner tube, which are separated from each other on the outer circumferential surface of the inner tube, and the sealing reinforcing component is provided with two positioning bumps fitted with the clamping grooves.

3. The extension tube for a vacuum cleaner according to claim 2, wherein the sealing reinforcing component is provided with an extension groove, and the extension groove is located on perpendicular bisectors of the two positioning bumps and is throughout the whole seal reinforcing component axially.

4. The extension tube for a vacuum cleaner according to claim 2, wherein the seal reinforcing component is provided with mounting notches on two ends, respectively, to sheath the seal reinforcing component on the inner tube conveniently.

5. The extension tube for a vacuum cleaner according to claim 1, wherein the sealing reinforcing component is provided with an extension groove, and the extension groove is located on perpendicular bisectors of the two positioning bumps and is throughout the whole seal reinforcing component axially.

6. The extension tube for a vacuum cleaner according to claim 1, wherein the seal reinforcing component is provided with mounting notches on two ends, respectively, to sheath the seal reinforcing component on the inner tube conveniently.

* * * * *